United States Patent [19]

Tarumi et al.

[11] 4,355,881

[45] Oct. 26, 1982

[54] RECORDING APPARATUS HAVING ROLLER TYPE FIXING DEVICE

[75] Inventors: Noriyoshi Tarumi, Hachioji; Kiyoaki Kawamoto, Kunitachi; Kenji Ueno, Hachioji; Hirofumi Sakaguchi, Akikawa, all of Japan

[73] Assignee: Konishiroku Photo Industry Co., Ltd., Tokyo, Japan

[21] Appl. No.: 161,866

[22] Filed: Jun. 23, 1980

[30] Foreign Application Priority Data

Jun. 28, 1979 [JP] Japan ..... 54-80779

[51] Int. Cl.[3] ..... G03G 15/20

[52] U.S. Cl. ..... 355/3 FU; 219/216; 355/14 FU; 432/60

[58] Field of Search ..... 355/3 R, 3 FU, 14 FU, 355/3 SH, 14 SH; 219/216, 469, 470, 471; 432/60, 228

[56] References Cited

U.S. PATENT DOCUMENTS

| | | | |
|---|---|---|---|
| 3,331,592 | 7/1967 | Cassano et al. | 355/3 FU X |
| 3,794,417 | 2/1974 | Machmer | 355/3 FU |
| 3,826,896 | 7/1974 | Thompson | 219/216 X |
| 3,846,151 | 11/1974 | Roteman et al. | 219/216 X |
| 3,898,425 | 8/1975 | Crandell et al. | 219/216 |
| 3,937,919 | 2/1976 | Clerx et al. | 219/216 |
| 4,188,109 | 2/1980 | Idenawa et al. | 355/3 FU |

*Primary Examiner*—Fred L. Braun

*Attorney, Agent, or Firm*—James E. Nilles

[57] ABSTRACT

A recording apparatus having a roller type fixing device made up of a first roller and a second roller for fixing the image to the transfer paper. The recording apparatus has an upper guide plate placed over the transfer paper passage on the inlet side of the roller type fixing device, the upper guide plate being curved down gradually toward the front end and extending near the lower portion of the first roller. The upper guide plate has on its underside a plurality of projecting strips extending in the direction of the paper feed.

6 Claims, 6 Drawing Figures

RECORDING APPARATUS HAVING ROLLER TYPE FIXING DEVICE

BACKGROUND OF THE INVENTION

1. Field of the Invention

The present invention relates to a recording apparatus with a roller type fixing device, in which the toner image formed on the image support member by some proper means is fixed to the support member (hereinafter referred to as a transfer paper) by pressure or heat, as in the transfer type electrophotographic copying machine or facsimile.

2. Description of the Prior Art

We will explain the drawbacks encountered with the conventional transfer type electrophotographic copying machine. We will take an example of the copying machines equipped with the roller type fixing device which consists of a heat roller having a heating element therein and a press roller that is pressed against the heat roller when rotating.

In transfer type electrophotographic copying machines, the copying process is generally carried out in the following manner: as shown in FIG. 1, the toner image formed on the rotating photosensitive drum 1 is transferred, by the electric discharge from the electrode 3, to the transfer paper (not shown) carried along the transfer paper passage P indicated by the single dot and dash line by means of the paper feed mechanism 2; the paper to which the image has been transferred is fed to the roller type fixing device by the transfer paper feed mechanism 4 comprised of rollers and a rubber belt; the transfer paper is fed between the heat roller 5A and the press roller 5B of the roller type fixing device to fix the image to the paper by the pressure and heat; and the processed paper is then passed through the guide mechanism 6 and discharged by the rollers 7 onto the tray 8.

This kind of copying machine, in which the roller type fixing device 5 is located downstream of the photosensitive drum 1 on the transfer paper passage P, has the following drawbacks. In recent years there are growing demands for a smaller copying machine which can process a larger size of paper. In order to meet these demands, an occasion will arise in which the distance along the paper passage P from the photosensitive drum 1 to the roller type fixing device 5 is shorter than the length of the transfer paper as measured in the same direction. In this case, when the front end of the transfer paper reaches the fixing device, the image transfer is still in the process at the rear end of the paper which is still in contact with the photosensitive drum 1. When the front end of the transfer paper strikes strongly against the outer surface of the heat roller 5A or the press roller 5B of the fixing device 5 while the rear end of the paper is still in contact with the photosensitive drum and the image is still being transferred, the paper is subjected to a shock that acts in the direction opposite to the paper feed, so that the rear end of the paper will slip relative to the outer surface of the drum 1 with which it was moving. This impairs the rear portion of the image. The strong collision of the front end of the paper against the heat roller or the press roller, as described above, occurs when the paper moves against the counterclockwise rotation of the heat roller. The paper is electrostatically attracted to the drum and must move in synchronism with it over the transfer electrode to produce a clear image on the paper. However, the smooth movement of the rear end portion of the paper will be obstructed until the paper's front end changes its direction and begins to move with the heat roller. This will cause the rear end of the paper to slip relative to the surface of the drum 1, impairing the image on the paper.

In the conventional copying machines so constructed that the paper is transferred along the horizontal level, there is provided a lower guide plate that defines the lower limit of the paper passage to prevent the front end of the paper from drooping downward. It is possible to prevent the collision of the front end of the paper against the roller 5B by placing the lower guide plate slightly higher than the horizontal line (not shown) passing through the contacting point between the two rollers of the fixing device or by setting the external surface of the lower guide plate at the extension of that horizontal line. The front end of the paper may also curl up and the degree of curling varies greatly depending on various conditions. In a machine in which the roller type fixing device 5 is a heat type fixing device, the front end of the paper is directed slightly upward to the heat roller 5A to prevent the formation of wrinkles on the paper. In this case, the front end of paper will strike against the heat roller 5A, impairing the image in a manner already described.

When the paper is deformed or when it is subjected to the wind blowing in the machine against only one side of the paper because of the structure of the machine, it is very likely that the paper will go out of alignment with the fixing device 5. If the paper in the misaligned condition is fed between the rollers of the fixing device 5, wrinkles will form on the paper.

SUMMARY OF THE INVENTION

The object of this invention is to provide an electrostatic recording apparatus with a roller type fixing device which is capable of smoothly introducing the front end of the transfer paper or copying paper (refer to as transfer paper hereinafter) into the roller type fixing device without letting the paper strike strongly against the rollers of the fixing device so that even if the image is still being transferred onto the rear portion of the paper when the front end of the paper has reached the fixing device, the image can be transferred without any impairment.

Another object of this invention is to provide a recording apparatus with a roller type fixing device which has an upper guide plate which is placed over the transfer paper passage on the inlet side of the roller type fixing device and which extends curving down toward the lower portion of the heat roller of the fixing device.

Other objects and features of this invention will become apparent from the following descriptions.

DESCRIPTION OF THE PREFERRED EMBODIMENTS

Referring to the accompanying drawings, we will explain the recording apparatus in which a so-called roller type fixing device made up of a heat roller (first roller) 5A and a press roller (second roller) 5B is located downstream of the photosensitive drum.

Figure 1:
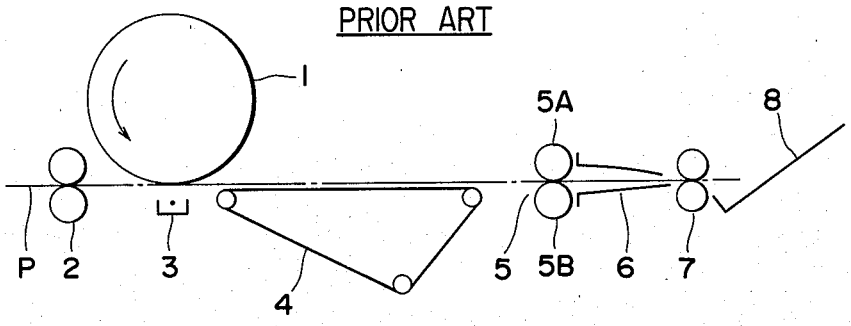
FIG. 1 PRIOR ART
FIG. 1 is a schematic view showing the construction of the conventional transfer type electrophotographic copying machine.
Figure 2:
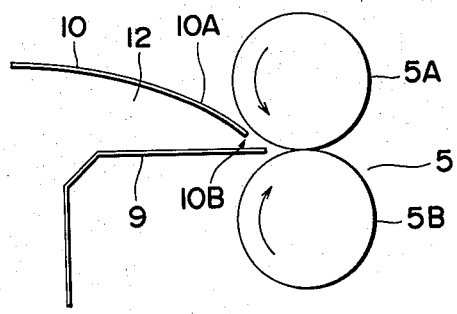
FIG. 2 is a side view of one embodiment of the recording apparatus of this invention.
Figure 3:
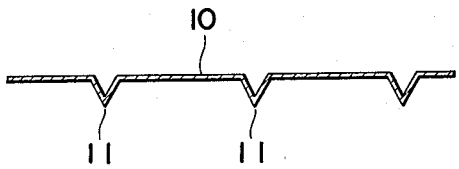
FIG. 3 is an enlarged cross section of a part of an upper guide plate.

As shown in FIG. 2, a lower guide plate 9 which is located immediately on the inlet side of the roller type fixing device 5 and defines the bottom of the transfer paper passage is extended toward the fixing device at a level equal to or slightly above the horizontal line passing through the contacting point between the two rollers of the fixing device 5.

Above the lower guide plate 9 there is provided an upper guide plate 10 which extends toward the roller type fixing device 5 gradually curving down toward the front end portion 10A so that the front edge 10B of the upper guide plate 10 is positioned near the point slightly above the contacting point between the two rollers. It is desirable that the upper guide plate 10 have on its underside a plurality of projecting strips 11 extending toward the roller type fixing device 5, i.e., in the direction of movement of the transfer paper. The upper guide plate 10 may be embossed to form a pattern of semi-globes of about 1 mm in diameter. In either case, the projecting strips or embossed patterns can minimize the deterioration of the image quality when the toner image on the transfer paper comes into contact with the upper guide plate 10. When the transfer paper is curled up so that the front end portion of the paper comes into contact with and slides along the upper guide plate 10, the raised pattern ensures smooth movement of the transfer paper because the friction that acts to retard the movement of the paper is produced by only the point contact at several locations and therefore is very small.

The heat roller 5A and the press roller 5B may be made of tetrafluoroethylene and silicone rubber, respectively.

In the recording apparatus with the above construction, the transfer paper delivered from the photosensitive drum is guided through a space 12 between the upper and lower guide plates 10, 9 and is held between the two rollers 5A, 5B of the fixing device which further feed the paper toward the exit (at the right in the drawings).

Since the upper guide plate 10 curves down toward the front end portion 10A and since the front edge 10B is positioned near the lower portion of the heat roller 5A, the front end of the transfer paper which is curled up away from the lower guide plate 9 can smoothly be slid along the undersurface of the upper guide plate 10 and guided toward the lower peripheral surface of the heat roller 5A. Without these guide plates, the curled paper would strike strongly against the outer surface of the heat roller 5A and the image transferring process would therefore be adversely affected by the shock. The paper is fed to the lower portion of the heat roller 5A at a level slightly higher than the contacting portion of the two rollers of the fixing device 5 so that the only force exerted by the heat roller to the paper as a result of collision is vertically downward and no reverse force is applied to the paper. In this way, the guide 10 allows the paper to be smoothly and stably fed between the rollers of the fixing device. If, when the front end of the transfer paper strikes the heat roller 5A, the image transfer process is still continuing at the rear portion of the paper, the image transfer process will not be impaired because no appreciable shock is produced by the collision.

With this invention, when the front portion of the transfer paper is slightly waved and is out of alignment with the contacting portion of the two rollers of the fixing device 5, the upper guide plate 10 guides the front portion of the paper to the correct position relative to the fixing device 5 to prevent the formation of wrinkles on the paper that would result without the upper guide plate when the paper is passed through the fixing device.

Since the front portion 10A of the upper guide plate 10 is gradually curved down, the front end of the paper is smoothly guided toward the fixing device 5. Moreover, the downwardly projecting strips 11 on the undersurface of the upper guide plate 10 reduces the contacting area between the upper guide plate and the upper surface of the paper on which the transferred image is deposited, so that smooth sliding movement of the paper is ensured and the image on the paper can be kept from being impaired.

Figure 4:
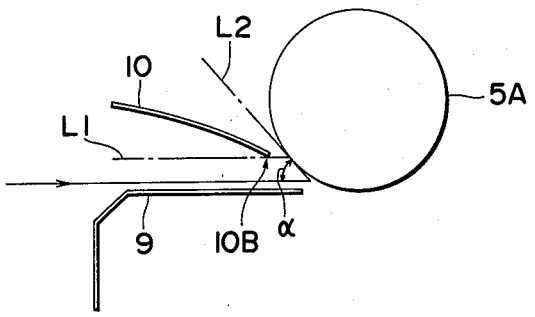
FIG. 4 is a schematic view showing the position of the front edge of the upper guide plate.

The position of the front edge 10B of the upper guide plate 10 with respect to the outer circumferential surface of the heat roller 5A must be such that, as shown in FIG. 4, the angle $\alpha$ subtended by the line $L_1$ drawn parallel to the direction of paper feed and passing through the front edge 10B and the line $L_2$ tangent to the circumferential surface of the heat roller 5A at the point where the line $L_1$ intersects the circumferential surface, is smaller than 80°, desirably 70°.

Figure 5:
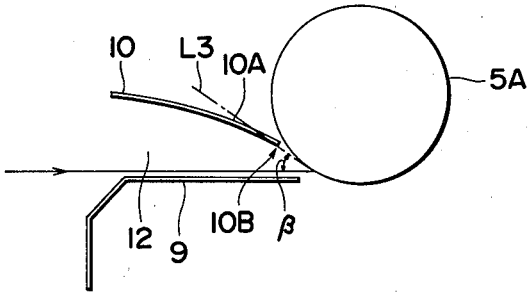
FIG. 5 is a schematic view showing the shape of the front portion of the upper guide plate.
Figure 6:
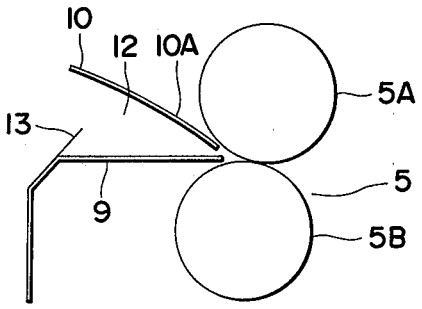
FIG. 6 is a side view of another embodiment of the recording apparatus of this invention.

If the angle $\beta$ made by the line parallel to the direction of paper feed and the tangent $L_3$ passing through the underside of the front edge 10B of the upper guide plate 10, as shown in FIG. 5, is large, the smooth sliding motion of the front end of the paper is likely to be hindered by the front edge 10B. But if small, the guiding effect will decrease. Thus, it is desirable that the angle $\beta$ be set between 10° and 50°, if possible between 20° and 40°.

To further facilitate the smooth introduction of the paper into the roller type fixing device, the heat roller 5A and the press roller 5B may be arranged so that the common tangent passing through the contacting point of the two rollers is inclined downwardly toward the downstream, as shown in FIG. 5. In this case, the upper guide plate 10 is arranged in a manner already mentioned and the lower guide plate 9 is preferably provided at the rear end with an elastic guide plate 13 which is inclined upward in the direction of paper feed.

With this construction, the upper guide plate 10 and the elastic guide plate 13 cooperate to cause the paper to curve downward so that the front end portion of the paper can be fed to the fixing device in a desirable attitude. This construction also has the advantage that the shock produced by the tension at the moment that the paper is held between the rollers of the fixing device 5 can be absorbed by the deformation of the guide plate 13.

As can be seen in the foregoing, this invention provides a very simple construction of the recording apparatus in which the transfer paper can be smoothly fed between the rollers of the fixing device without producing any shock to the paper and in which if the image transfer process is still being carried out when the front end of the paper is held and drawn into the fixing device, the impairment of the image can be prevented. Thus, with this invention it is possible to produce a small electrophotographic copying machine which is capable of handling large transfer paper.

What is claimed is:

1. A recording apparatus having a roller type fixing device made up of a first roller and a second roller for fixing the image to the transfer paper, comprising an upper guide plate placed over the transfer paper passage on the inlet side of the roller type fixing device, the upper guide plate being curved down gradually toward the front end of the fixing device in the direction of the paper feed and having a front edge extending near the lower portion of the first roller so that an angle $\alpha$ less than 80° is made by a line parallel to the direction of the paper feed and a line tangent to the outer circumferential surface of the first roller at a point where a line passing through the front edge of the upper guide plate intersects the circumferential surface of the first roller.

2. A recording apparatus as set forth in claim 1, wherein an angle $\beta$ made by a line parallel to the direction of the paper feed and a line passing through the front edge of the upper guide plate and tangent to the outer circumferential surface of the first roller is between 10° and 50°.

3. A recording apparatus as set forth in claim 1 or 2, wherein the angle $\alpha$ is 70°.

4. A recording apparatus having a roller type fixing device made up of a first roller and a second roller for fixing the image to the transfer paper, comprising an upper guide plate placed over the transfer paper passage on the inlet side of the roller type fixing device, the upper guide plate being curved down gradually toward the front end of the fixing device in the direction of the paper feed and having a front edge extending near the lower portion of the first roller so that an angle $\beta$ made by a line parallel to the direction of the paper feed and a line passing through the front edge of the upper guide plate and tangent to the outer circumferential surface of the first roller is between 10° and 50°.

5. A recording apparatus as set forth in claim 1 or 2 or 4, wherein the upper guide plate has on its underside a plurality of projecting strips extending in the direction of the paper feed.

6. A recording apparatus as set forth in claim 2 or 4, wherein the angle $\beta$ is between 20° and 40°.

* * * * *